US006155306A

United States Patent [19]

Katsukura et al.

[11] Patent Number: 6,155,306

[45] Date of Patent: Dec. 5, 2000

[54] BULLETPROOF WOVEN FABRIC, AND METHOD AND APPARATUS FOR WEAVING SAME

[75] Inventors: Shozo Katsukura, Sabae; Mikine Katsukura, Toshima-ku, both of Japan

[73] Assignee: Shozo Katsukura, Fukui, Japan

[21] Appl. No.: 08/936,893

[22] Filed: Sep. 25, 1997

[30] Foreign Application Priority Data

Sep. 25, 1996 [JP] Japan ..... 8-253548
Sep. 25, 1996 [JP] Japan ..... 8-253549

[51] Int. Cl.[7] ..... D03D 41/00

[52] U.S. Cl. ..... 139/11; 139/1 R; 139/435.1; 139/DIG. 1; 28/282; 442/97

[58] Field of Search ..... 442/97, 98, 100; 28/282; 139/1 R, 11, 435.1, DIG. 1

[56] References Cited

U.S. PATENT DOCUMENTS 5,935,881 8/1999 Abiru et al. ..... 442/97

*Primary Examiner*—John J. Calvert
*Assistant Examiner*—Robert H. Muromoto, Jr.
*Attorney, Agent, or Firm*—Wenderoth, Lind & Ponack, LLP

[57] ABSTRACT

A woven fabric enhancing bulletproof ability by efficiently absorbing kinetic energy of a bullet discharged from a gun, which is not softened or molten by heat of the bullet at high temperatures, in which non-twisted multifilament yarns are opened and the filament yarns are aligned such that the cross-sectional shape thereof is flattened as a whole and the fabric is woven while keeping fiber axes of the filaments substantially linear. Warps and wefts comprise such multifilament yarns, the warp comprising polyethylene fibers excellent in mechanical property, the weft comprising aramide fibers excellent in thermal property. In order to prevent lowering of the bulletproof ability caused by crimping or the like of the multifilament yarns and to sufficiently utilize the mechanical properties of the fiber material, multifilament yarns each having a count of 50 through 1600 deniers comprising filaments each having a count of less than 10 deniers are used as the warps and wefts. In respect of the warps, the multifilament yarns are woven by a water jet loom after being opened, sized and dried, and in respect of the wefts, the multifilament yarns are woven by a water jet loom without being subjected to the opening and sizing operation.

5 Claims, 11 Drawing Sheets

BULLETPROOF WOVEN FABRIC, AND METHOD AND APPARATUS FOR WEAVING SAME

BACKGROUND OF THE INVENTION

1. Field of the Invention

The present invention relates to a bulletproof woven fabric capable of preferably being used as a so-called bulletproof jacket for protecting a body or the like against a bullet or the like discharged from a gun, and further to a method of weaving the same as well as a warping apparatus and an opening apparatus therefor.

Further the invention relates to a woven fabric preferable as a bulletproof woven fabric or the like for protecting a body or the like against, for example, a bullet discharged from a gun.

2. Description of the Related Art

A multifilament yarn constituted by bundling two or more filaments has excellent orientation of fibers and high density, and therefore the tensile strength and elongation are superior to those of a spun yarn. Accordingly, the multifilament yarn is preferable for use of a bulletproof woven fabric. According to such a multifilament yarn, filaments constituting the multifilament yarn are liable to cut by being brought into frictional contact with a guide member for determining a yarn passage or being brought into frictional contact with a reed or the like in a weaving process and a weaving preparatory process prior thereto. Even when a single filament is cut, the yarn is fluffed and the operation has to be stopped.

In order to resolve the problem and prevent the collectness of filaments from deteriorating and prevent the yarn from separating into individual filaments, a filament textured yarn produced by pertinently twisting the yarn or injecting highly compressed air from the transverse direction to a yarn bundle in running it thereby entangling the filaments.

According to the slightly twisted multifilament yarn and textured filament yarn, the orientation of fibers is lowered and accordingly, mechanical properties required of a bulletproof woven fabric are deteriorated.

Further, it is important for enhancing bulletproof ability that not only the mechanical properties of the warp and the weft are excellent but the yarn is not molten by a bullet or debris thereof at high temperatures and the mechanical properties are maintained.

SUMMARY OF THE INVENTION

It is an object of the invention to provide a bulletproof woven fabric having excellent bulletproof ability.

It is another object of the invention to provide a method of weaving a bulletproof woven fabric and provide a warping apparatus and an opening apparatus used for weaving the bulletproof woven fabric.

It is still another object of the invention to provide a woven fabric suitable for a bulletproof fabric or the like having improved mechanical properties and thermal properties.

The invention provides a bulletproof woven fabric comprising:

non-twisted multifilament yarns opened by arranging filaments such that a cross-sectional shape thereof is flattened as a whole, the non-twisted multifilament yarns being used as warps and wefts, wherein weaving is performed while keeping fiber axes of the filaments substantially linear.

According to the invention, a plurality of filament yarns constituting the multifilament yarn are arranged and opened such that the cross-sectional shape of the multifilament yarn is flattened as a whole where the multifilament yarn is not twisted, that is, non-twisted and not worked. Therefore, the multifilament yarn used in the invention has excellent orientation of fibers, high density and accordingly excellent mechanical properties for enhancing bulletproof ability, for example, sufficiently large values in tensile strength and initial tensile modulus. Further, the multifilament yarns are non-twisted and no work of entanglement or the like is performed thereon, and therefore no crimp is caused. Accordingly, the shock wave caused in impacting a bullet discharged from a gun to the woven fabric, propagates smoothly in the filaments, the kinetic energy of the bullet is dispersed in the woven fabric in a wide range and the kinetic energy of the bullet is dissipated by being efficiently converted into breakage of the filament.

According to the invention, the fiber axes of filaments are kept substantially linear and there is no twist or crimp as described above and therefore, the bulletproof ability is enhanced as mentioned above.

According to the invention, the fabric is woven while keeping the fiber axes of filaments constituting the multifilament yarns substantially linear, and therefore the mechanical properties of the multifilament yarns can effectively be utilized, that is, the fabric can be used without lowering the tensile strength and the initial tensile modulus by which the kinetic energy of the bullet discharged from the gun can be propagated and dispersed in a wide range and by which the kinetic energy of the bullet can be converted into energy for breaking fibers or the like in a short period of time such that a body is not injured. Thus, the bulletproof ability of the bullet proof woven fabric of the invention is enhanced. According to the bulletproof woven fabric of the invention, the bulletproof ability that is uniform in all the directions in the face of the woven fabric can be provided.

Further, according to the invention, compared with multifilament yarns having a sectional face in, for example, a substantially circular shape, gaps at crossing points of warps and wefts can be reduced by which the bulletproof ability can also be enhanced.

Further, according to the invention, the cross-sectional shape of the multifilament yarn is flattened as a whole by the opening operation and therefore, gaps at crossing points of warps and wefts are reduced by which the bulletproof ability can also be enhanced.

Further, according to the invention, the multifilament yarns are difficult to loosen after weaving the fabric, the original shape is maintained and therefore, even if the fabric is used in a state of mounting to a human body, there is no concern of lowering the bulletproof ability.

Further, according to the invention, by using the opened multifilament yarns as warps and wefts, the gaps are reduced as mentioned above, after weaving, the respective multifilament yarns are difficult to loosen, the original weaving texture can be maintained and the shape of the bulletproof woven fabric when it is actually worn as, for example, a bulletproof jacket, is difficult to deform unintentionally.

Further, in the invention it is preferable that the bulletproof woven fabric is one of a plain weave, a twill weave and a satin weave.

According to the invention, the invention comprises one of a plain weave, a twill weave and a satin weave and further, textures produced by deforming these whereby the woven shape is difficult to deteriorate.

Still further in the invention it is preferable that the multifilament yarn is of 50 through 1600 deniers and each of a plurality of filaments constituting the multifilament yarn is of less than 10 deniers.

According to the invention, filaments of 1 through 10 deniers may be bundled to constitute a multifilament yarn of 50 through 1600 deniers. For example, a multifilament yarn of 200 deniers may be constituted by 195 filaments. Filaments constituting the multifilament yarn have the same dimensions and shape.

By constituting the multifilament yarn by filaments of about 25 or more, 100 or more and further, about 200 or more as mentioned above, the density can be increased and a uniform yarn can be constituted whereby the bulletproof ability can be enhanced.

According to the invention, by using the multifilament yarn of 50 through 1600 deniers comprising filaments having counts of less than 10 deniers, the yarn is opened to improve the orientation of fibers as mentioned above and the density can be increased by which the tensile strength and the initial tensile modulus can be enhanced.

Further, the invention provides a method of weaving a bulletproof woven fabric in which a water jet loom is used, the method comprising:

in respect of warp, opening a multifilament yarn;

sizing the opened multifilament yarn;

thereafter, drying the sized multifilament yarn; and looming the dried multifilament yarn to the water jet loom, and in respect of weft, flowing a multifilament yarn by a water jet stream without opening and sizing to weft-insert at the water jet loom.

According to the invention, in respect of the weft, the multifilament yarn is opened, that is, the multifilament yarn is brought into a state where filaments are arranged without overlapping each other in the up and down direction or partially overlapping each other in the up and down direction such that the sectional shape thereof is flattened as a whole, sized and thereafter, dried and woven by being loomed to the water jet loom. By contrast, in respect of the weft, the multifilament yarn is flown by a water jet stream at the water jet loom, put into the weft inserting motion through a shed formed by dividing the warps loomed on the loom in the up and down direction. In this way, the fabric is woven by the shedding motion by the heald, the weft inserting motion of the weft by the water jet stream and the beating-up motion by the reed.

According to the weaving method, in respect of the warp, the multifilament yarn sized in the opened state is dried and loomed to the water jet loom and the weft is flown by the water jet stream and put into the weft inserting motion without being opened or sized and therefore, the weft can easily be opened pertinently by water.

Further, in the invention it is preferable that in the sizing operation is used a size including polyvinyl alcohol or an acrylic group size material.

According to the invention, for example, polyvinyl alcohol or an acrylic group size material, for example, acrylic acid ester or the like is used as the size and accordingly, degumming operation such as desizing can easily be performed after weaving the fabric. The size does not contribute to enhancing the bulletproof ability and the desizing operation is useful in reducing weight when the bulletproof woven fabric is used as a clothing such as a bulletproof jacket.

According to the invention, polyvinyl alcohol or an acrylic group size material is used for the size by which the state of opening the multifilament yarn is maintained and further, the drying operation is facilitated.

Further, in the invention it is preferable that desizing is performed after weaving the fabric.

According to the invention, the weft is the multifilament yarn which is not subjected to the operation of twisting and crimping or the like and further, is not subjected to the opening operation and the sizing operation and is led to the shed along with water from a nozzle. The water can prevent the respective filaments from being disintegrated apart by enlarging intervals therebetween and bring the weft into the opened state having a density substantially the same as that of the warp. The weft can be brought into the opened state in this way by adjusting the flow rate and the speed of the water jet and a time period of injecting water in synchronism with the operation of putting the weft into the weft inserting motion through the shed and the like. Water is adhered to the entire length of the weft inserted into the shed.

According to the invention, weight reduction can be achieved by removing the size which does not effect influence on the bulletproof ability through desizing operation using such a size, which is important when such a particularly woven fabric is used as material of, for example, a bulletproof jacket or the like.

Further, in the invention it is preferable that the weft is brought into the opened state by adjusting the water jet stream during flying of the weft.

In respect of the weft, intervals among the filaments are enlarged in flying the weft in the weft inserting motion and after flying the weft, the weft is pinched by upper and lower crossing warps by which the cross-sectional shape of the weft is flattened. In this way, the fabric is woven under a state where the weft is opened.

According to the invention, by adjusting the water jet stream in the water jet loom for opening the weft, that is, by adjusting the flow rate and the speed or the like of water, the weft can automatically be opened by arranging filaments of the weft in the direction of fiber axes of warps in flying the weft. Thereby, the constitution can significantly be simplified.

According to the concept of the invention, not only the water jet loom but a shuttleless loom such as an air jet loom, a Rapier loom, a gripper shuttle loom represented by Sulzer or the like may be used.

Further, the invention provides a warping apparatus comprising:

(a) a creel for supporting a plurality of bobbins each wound with a non-twisted multifilament yarn;

(b) tension applying means for applying a tension to the multifilament yarn drawn from the bobbin;

(c) an opening apparatus for arranging filaments such that a cross-sectional face of the multifilament yarn from the tension applying means is flattened as a whole;

(d) a sizing apparatus arranged on the downstream side of the opening apparatus, for sizing the multifilament yarn from the opening apparatus;

(e) a drying apparatus arranged on the downstream side of the sizing apparatus, for drying a size adhered to the multifilament yarn; and (f) winding means for winding the multifilament yarn dried by the drying apparatus while applying a tension to the multifilament yarn.

Further, the invention provides a warping apparatus comprising:

(a) a creel for supporting a plurality of bobbins each wound with a multifilament yarn;

(b) tension applying means for applying a tension to the multifilament yarn drawn from the bobbin;

(c) an opening apparatus:

wherein first, second and third guide rollers are arranged in the direction of running the multifilament yarn from the tension applying means;

wherein the first, second and third guide rollers each have an outer diameter uniform in an axial direction and a rotational axis line orthogonal to the running direction;

wherein the axis line of the second guide roller is arranged shifted to one side in respect of one plane including the axis lines of the first and third guide rollers;

wherein the multifilament yarn is made to wrap on the first guide roller on other side in respect of the one plane; and wherein the multifilament yarn is made to wrap on an outer peripheral face of the third guide roller on the one side in respect of the one plane and remote from the one plane, the opening apparatus further comprising:

driving means for driving respectively the first, second and third guide rollers such that peripheral speeds V1, V2 and V3 of the first, second and third guide rollers establish the following relationship $$V1>V2>V3$$

(d) a sizing apparatus arranged on the downstream side of the opening apparatus, including:

a size box for storing a size; and a sizing roller a lower portion of which is partially dipped in the size, the sizing roller having a horizontal rotational axis line;

wherein the multifilament yarn from the opening apparatus is run in contact with an upper portion of the sizing roller;

(e) a drying apparatus arranged on the downstream side of the sizing apparatus, for drying the size adhered to the multifilament yarn; and (f) winding means for winding the multifilament yarn dried by the drying apparatus while applying a tension to the multifilament yarn.

According to the invention, the multifilament yarns from a plurality of bobbins supported by the creel, are applied with a tension between the tension applying means and the winding means. Filaments constituting each of the multifilament yarns, are arranged contiguously one by one on the outer peripheral faces of particularly the second and third guide rollers in the opening apparatus installed between the tension applying means and the winding means. In this way, each of the multifilament yarns is opened such that the cross-sectional shape thereof is flattened as a whole and led to the sizing apparatus under this state and brought into contact with the upper peripheral face of the sizing roller, the multifilament yarns are adhered with the size and thereafter, the size is dried by the drying apparatus. The multifilament yarns which have been dried in this way, are wound to a beam, a drum or the like by the winding means.

In the conventional art, a multifilament yarn that is a grey yarn is subjected to a twisting operation, entangling or the like, wound once to a bobbin, a drum, a beam or the like. Thereafter, in order to perform a sizing operation, the multifilament fabricated yarn that is wound, is drawn, run and sized and is again wound to a bobbin, a drum, a beam or the like. Accordingly, in the conventional art, enormous labor and time are needed and the productivity is poor. According to the invention, multifilament yarn is opened and thereafter, sized at once and wound, with the result that the productivity is excellent.

According to another concept of the invention, a single multifilament yarn may be wound to a single bobbin and the single multifilament yarn may be wound after opening and sizing operation.

According to the warping apparatus, the multifilament yarn applied with a tension between the tension applying means and the winding means, can be opened by the opening apparatus and thereafter, sized by the sizing apparatus and further, dried by the drying apparatus after the sizing operation and in this way, the warp can be subjected to the warping operation while maintaining the automatically opened shape.

Further, in the invention it is preferable that a guide member for guiding the multifilament yarn from the bobbin is provided in the range of a yarn layer of multifilaments wound around while being shifted in a direction orthogonal to the axis line of the bobbin supported by the creel and further, along the axis line direction of the bobbin.

In the creel, the guide member for guiding the multifilament yarn in the direction orthogonal to the axis line of the bobbin is installed and the guide member is arranged in a range of a layer of the multifilament yarn wound to the bobbin along the axis line direction of the bobbin by which when the multifilament yarn is drawn from the bobbin, the multifilament yarn can be prevented from being twisted. The guide member may be a plate having a guide hole for inserting the multifilament yarn or may be other constitution, for example, mekubari or the like. The guide member can smoothly draw the multifilament yarn by being arranged at a central position of the layer of the multifilament yarn wound around the bobbin in respect of the axis line direction of the bobbin. The bobbin is rotatably installed to the creel.

According to another concept of the invention, the guide member may be arranged in the axis line direction of the bobbin spaced apart therefrom by an interval and the filament yarn may be drawn without rotating the bobbin. According to such a constitution, although the multifilament yarn is slightly twisted, the constitution does not effect significant adverse influence on the opening operation.

According to the invention, the guide member is arranged by being shifted in a direction orthogonal to the axis line of the bobbin and the guide member does not have a constitution where the guide member is installed in the axis line direction of the bobbin and therefore, the multifilament yarn drawn from the bobbin is prevented from being twisted by which the opening operation can be performed firmly.

Further, the invention provides an opening apparatus comprising:

first, second and third guide rollers, the first, second and third guide rollers being arranged in a running direction of a multifilament yarn;

the first, second and third guide rollers each having an outer diameter uniform in an axis line direction and a rotational axis line orthogonal to the running direction;

wherein the axis line of the second guide roller is arranged shifted on one side in respect of a plane including the axis lines of the first and third guide rollers, wherein the multifilament yarn is made to wrap on the first guide roller on other side in respect of the plane;

wherein the multifilament yarn is made to wrap on an outer peripheral face of the third guide roller on the one side in respect of the one plane and remote from the one plane;

wherein the multifilament yarn is made to wrap on the third guide roller on the other side in respect of the one plane, the opening apparatus further comprising:

driving means for respectively driving the first, second and third guide rollers such that peripheral speeds V1, V2 and V3 of the first, second and third guide rollers establish the following relationship $$V1>V2>V3; \text{ and}$$

tension applying means for applying a tension to the filament yarn, installed on the upstream side of the first guide roller in the running direction and on the downstream side of the third guide roller in the running direction.

According to the invention, the multifilament yarn applied with the tension between the upstream side and the downstream side of the first and third guide rollers, is run by being guided by being made to wrap partially on the outer peripheral face of the first guide roller, that is, over an angle less than 360°, made to wrap on the outer peripheral face of the second guide roller and thereafter, made to wrap on the outer peripheral face of the third guide roller. The first, second and third guide rollers each have the outer diameter uniform in the axis line direction, that is, a shape of a right circular column or the shape of a right cylinder and has the rotational axis line orthogonal to the running direction of the multifilament yarn. For example, the axis lines of the first and third guide rollers may be disposed substantially in one plane and the axis line of the third guide roller may be in parallel with the one plane. What is particularly important is that the peripheral speeds V1, V2 and V3 of the first, the second and third guide rollers are set smaller successively in this order and accordingly, the tension operating on the multifilament yarn is successively changed among the first, second and third guide rollers. Thereby, the multifilament yarn is opened such that respective filaments are displaced contiguously to each other in a direction orthogonal to the fiber axes of the respective filaments and the respective filaments do not overlap each other in the up and down direction.

According to the opening apparatus, by changing the tension of the multifilament yarn among the first, second and third guide rollers, the multifilament yarn can be opened by parallelly placing filaments by making uniform intervals among the filaments.

In the invention it is preferable that the first, second and third guide rollers each are provided with a fluororesin coated layer.

Further, according to the invention, each surface of the first, second and third guide rollers is coated with a fluororesin and the fluororesin may be, for example, polytetrafluoroethylene or the like which is commercially available as Teflon (commercial name). By such a coated layer, the frictional coefficient thereof in respect of the multifilament yarn is reduced and accordingly, the respective filaments can be opened smoothly in the fiber axes direction.

According to the invention, by a layer coated with a synthetic resin such as fluororesin, the frictional coefficient thereof in respect of the filament is reduced and accordingly, the multifilament yarn can be opened further uniformly.

Further, in the invention it is preferable that means for removing static electricity of the multifilament yarn on the upstream side of the first guide roller in the running direction of the multifilament yarn is provided.

Further, according to the invention, the means for removing static electricity is provided on the upstream side of the first guide roller thereby removing electricity of the multifilament yarn. Thereby, the plurality of filaments can be opened by uniformly arranging the filaments with no overlapping at the first, second and third guide rollers. When the multifilament yarns is charged with static electricity, repulsive force caused by static electricity is operated on the respective filaments constituting the multifilament yarn. Such a static electricity is not distributed uniformly in the direction orthogonal to the fiber axis of the multifilament yarn and intervals among the filaments may become nonuniform after the opening operation. According to the invention, in order to resolve the problem, electricity is removed, by which the multifilament yarn can be opened by arranging the filaments contiguous to each other or at equal intervals, that is, making uniform the density in the direction orthogonal to the fiber axis.

According to the invention, the uniform opening operation can be performed by removing electricity from the filament yarn and no dispersion is caused in the intervals between the respective filaments by a repulsive force of nonuniform static electricity.

The invention provides a woven fabric comprising:

non-twisted multifilament yarns opened by arranging filaments such that a cross-sectional shape thereof is flattened as a whole, the non-twisted multifilament yarns being used as warps and wefts, wherein weaving is performed while keeping fiber axes of the filaments substantially linear, and wherein either one of the warp and the weft is superior to the other in mechanical property and the other is superior to the one in thermal property.

According to the invention, the multifilament yarn is opened by arranging a plurality of filaments constituting the multifilament yarn such that the cross-sectional shape of the multifilament yarn is flattened as a whole and the multifilament yarn is not twisted, that is, non-twisted and subjected to no working. Accordingly, in respect of the multifilament yarn used in the invention, the orientation of fibers is excellent, the density is high and accordingly, mechanical properties for enhancing the bulletproof ability are excellent, for example, the tensile strength and the initial tensile modulus have sufficiently large values. Furthermore, the filament yarn is non-twisted, is not subjected to working such as entanglement or the like and no crimp is caused. Therefore, the shockwave caused in impacting a bullet discharged from a gun to the woven fabric, propagates smoothly in the filaments, the kinetic energy of the bullet is dispersed in the woven fabric in a wide range and the kinetic energy of the bullet is dissipated by being efficiently converted into breakage of the filaments.

According to the invention, the fiber axes of the filaments are kept substantially linear and no twist and crimp or the like are present as mentioned before and accordingly, the bulletproof ability is enhanced as described above.

According to the invention, the fabric is woven while keeping the fiber axes of the filaments constituting the multifilament yarn substantially linear, and accordingly the mechanical properties of the multifilament yarn are effectively used, that is, the multifilament yarn can be used without deteriorating the tensile strength and the initial tensile modulus by which the kinetic energy of bullet discharged from the gun can be propagated and dispersed in a wide range and by which the kinetic energy can be converted in a short period of time into energy for breaking fibers or the like such that a body is not injured. In this way, the bulletproof ability of the bulletproof woven fabric is enhanced. According to the bulletproof woven fabric of the invention, the bulletproof ability that is uniform in all the directions in the face of the woven fabric can be attained.

Further, according to the invention, compared with a multifilament yarn having a sectional face in, for example, a substantially circular shape, the gaps at crossing points of warps and wefts can be reduced by which the bulletproof ability can further be enhanced.

Further, according to the invention, the cross-sectional face shape of the multifilament yarn is flattened as a whole by the opening operation and accordingly, the gaps at the positions of crossing warps and wefts are reduced by which the bulletproof ability can further be enhanced.

Further, according to the invention, the multifilament yarn is difficult to loosen after the fabric is woven, the original shape is maintained and accordingly, even when the multifilament yarn is used in a state of being worn by a human body, there is no concern of deteriorating the bulletproof ability.

Further, according to the invention, by using the opened multifilament yarns as warps and wefts, the gaps are reduced as mentioned above, the respective filament yarns are difficult to loosen after weaving the fabric, the original weaving texture can be maintained and the shape of the bulletproof woven fabric when the bulletproof woven fabric is actually worn as, for example, a bulletproof jacket or the like, is difficult to deform unintentionally.

According to the invention, one of the warp and the weft is excellent in mechanical property and the other is excellent in thermal property. Therefore, the kinetic energy of a bullet can be instantaneously propagated and dispersed in a wide range and converted into other energy effecting no injuries to a body or the like and the bulletproof ability can be maintained even under high temperature condition by the other of the warp and the weft excellent in thermal property. Excellency in mechanical property signifies that the tensile strength and the initial tensile modulus are large and signifies further that Young's modulus is large. Further, excellency in thermal property signifies that a softening point and a melting point are high, signifies that thermal decomposition temperature is high and heat resistance is excellent and signifies further that thermal fatigue performance is excellent. Also, the excellency signifies that flame resistance is excellent.

According to the invention, the warp and weft individually have excellent mechanical and thermal properties, respectively and therefore, the woven fabric is excellent both in mechanical and thermal properties and is not soften or molten by a bullet at high temperatures and further, the kinetic energy of the bullet can be propagated and dispersed instantaneously in a wide range and converted into other energy effecting no injury on a body or the like and the bulletproof ability can be enhanced.

Further, in the invention it is preferable that the one is of polyethylene fiber and the other is of aramide fiber.

According to the invention, by using polyethylene fiber, the mechanical properties of the woven fabric are improved and the tensile strength and initial tensile modulus are increased. Further, by using aramide fire such as Kevlar, the heat resistance is enhanced and drawbacks of polyethylene fiber where the softening point and the melting point are low are complemented. Also, polyethylene fiber is superior to aramide fiber in mechanical property which complements the mechanical properties of aramide fiber. Polyethylene fiber is softened and molten at about 80° C. whereas aramide fiber has a melting point of 320 through 570° C. and excellent in heat resistance.

According to the invention, polyethylene fiber is excellent in mechanical property and aramide fiber is excellent in thermal property thus realizing a woven fabric having excellent properties of both.

Further, in the invention it is preferable that the polyethylene fiber has a tensile strength of 30 g/d or more and an initial tensile modulus of 900 g/d or more.

According to the invention, it has been confirmed that by providing polyethylene fiber having the tensile strength of 30 g/d or more and the initial tensile modulus of 900 g/d or more, the bulletproof ability can be secured and the kinetic energy discharged at a close range of a gun can be converted into other energy effecting no injures to a body. The tensile strength is preferably about 40 d/g or more and the initial tensile modulus is preferably 1.0 g/d or more.

According to the invention, the tensile strength and the initial tensile modulus of polyethylene fiber are enhanced by which the bulletproof ability is enhanced.

Further, in the invention it is preferable that the multifilament yarn is of 70 through 1200 deniers and each of the plurality of filaments constituting the multifilament yarn is of less than 10 deniers.

According to the invention, the multifilament yarn comprising filaments having counts of 1 through 10 deniers, preferably, 2 through 9 deniers is made to have a count of 70 through 1200 deniers, preferably 200 through 1000 deniers and the orientation of the fiber is improved, to obtain a woven fabric woven at high density, whereby a woven fabric sufficiently achieving the mechanical properties of the multifilament yarn, for example, excellent in the bulletproof ability can be realized.

According to the invention, a woven fabric utilizing excellent characteristics of the multifilament yarn having excellent orientation of fiber and high density, is realized by which a woven fabric excellent in mechanical property is realized.

Further, the invention provides a woven fabric comprising:

non-twisted multifilament yarns opened by arranging filaments such that a cross-sectional shape thereof is flattened as a whole, the non-twisted multifilament yarns being used as warps and wefts, wherein weaving is performed while keeping fiber axes of the filaments substantially linear, and wherein either one of the warp and the weft is a combined filament yarn having different mechanical and thermal properties.

According to the invention, one or both of the warp and the weft is a combined filament yarn. That is, a plurality of filaments constituting the multifilament yarn comprise, for example, polyethylene fibers and aramide fibers and a single multifilament yarn is constituted by mixing together the two kinds of filaments separately one by one. Two kinds or more of filaments may be used.

Further, according to the invention, the woven fabric may be a union cloth. That is, the warp may comprise polyethylene fibers and aramide fibers and the weft may comprise polyethylene fibers and aramide fibers, or only the weft may comprise either one of polyethylene fibers and aramide fibers and the weft may comprise the other of polyethylene fibers and aramide fibers.

The invention can not only be used as a bulletproof woven fabric but can be executed in a wide range of usage requiring strength and heat resistance such as an airship, a balloon or the like, in musical instruments and further, in other usages.

According to the invention, either one or both of the warp and the weft is a combined filament yarn and accordingly, as mentioned above, a woven fabric excellent in mechanical property and thermal property is realized.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
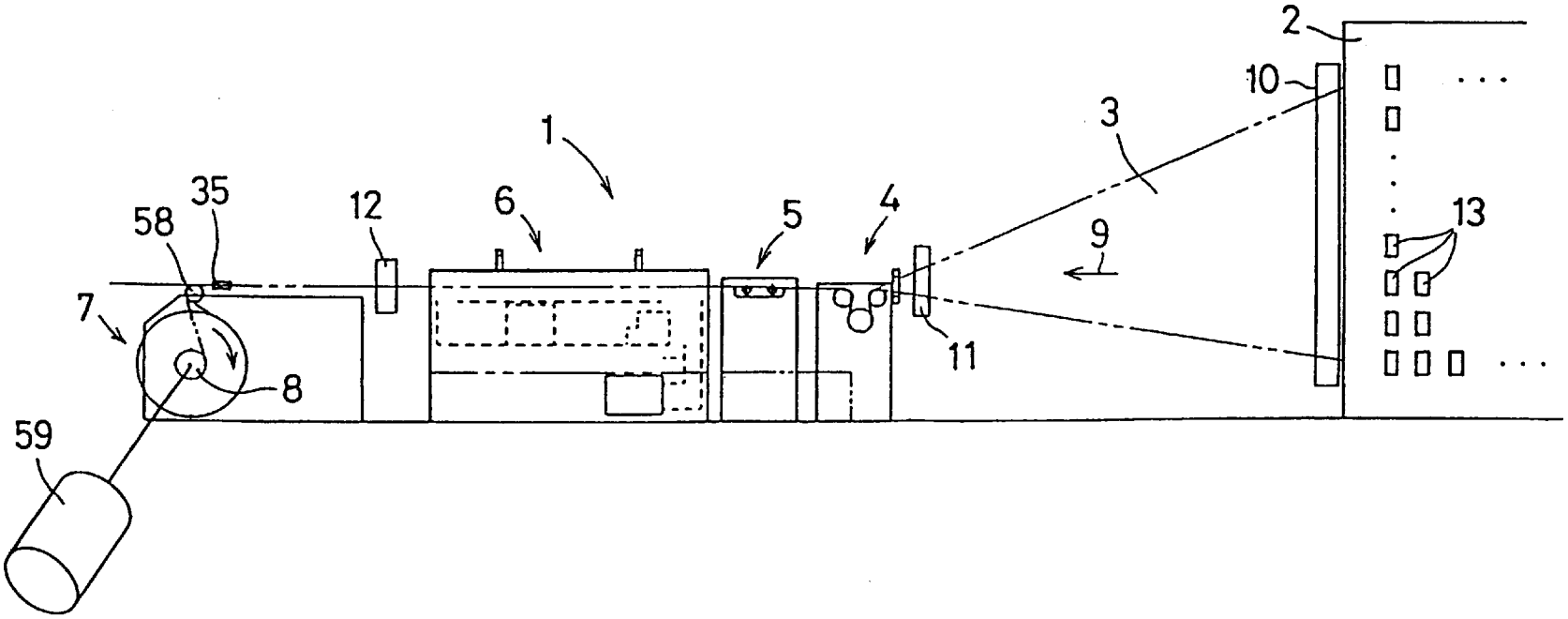
FIG. 1 is a side view of a warping apparatus 1 according to an embodiment of the invention.

Now referring to the drawings, preferred embodiments of the invention are described below.

Figure 2:
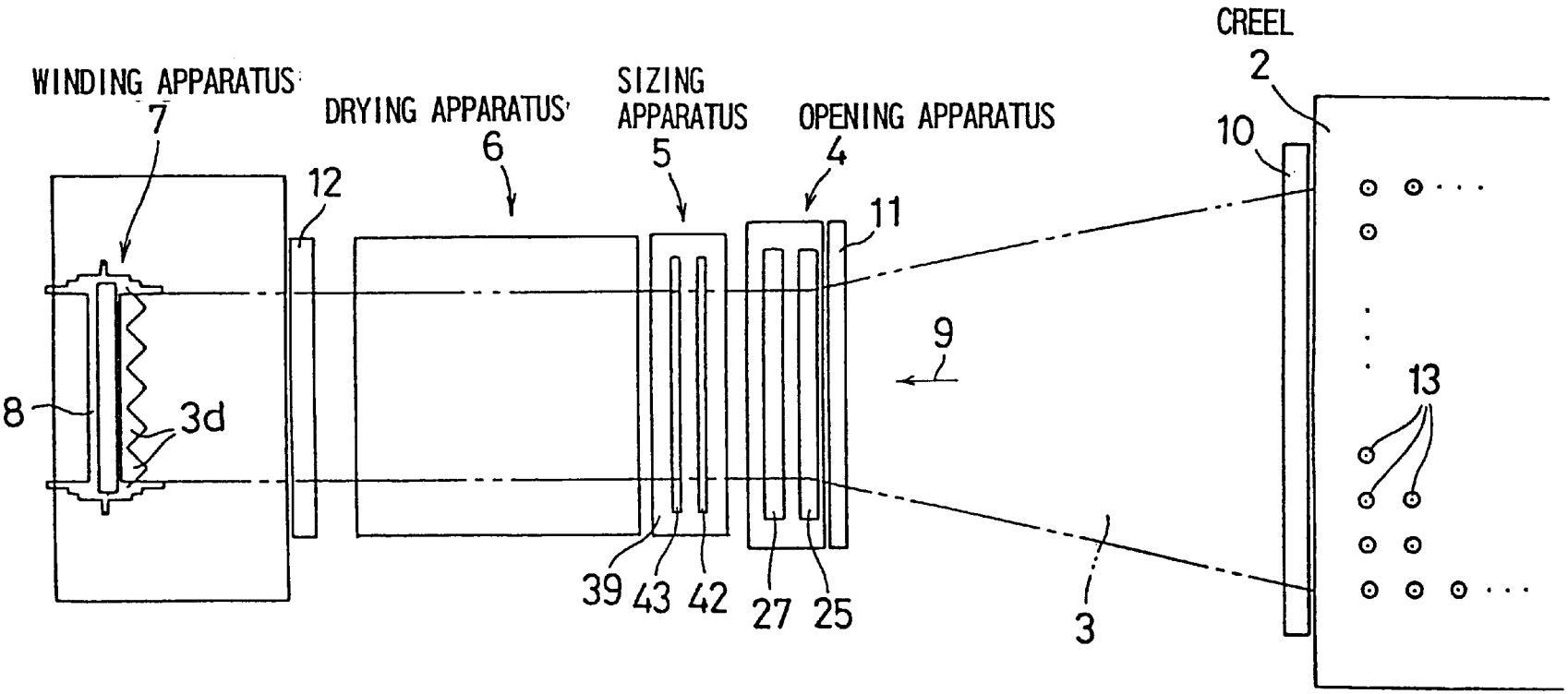
FIG. 2 is a plane view of the warping apparatus 1.

FIG. 1 is a side view of a warping apparatus 1 according to an embodiment of the invention and FIG. 2 is a plane view of the warping apparatus 1. In respect of a plurality of multifilament yarns 3 (e.g., 600 yarns) from a creel 2, filaments are parallelly placed such that a cross-sectional shape of each multifilament yarn 3 is flattened as a whole by an opening apparatus 4, and thereafter the filaments are sized by a sizing apparatus 5. After the size is dried by a drying apparatus 6, the filaments are wound to the beam 8 or a drum by the winding apparatus 7.

Electricity removing means 10 for removing static electricity of the multifilament yarns 3 is installed at a vicinity of the creel 2 on the downstream side in a direction 9 of running the multifilament yarns 3 and means 11 for removing static electricity of the multifilament yarns 3 is installed on the upstream side of the opening apparatus 4 in the running direction 9 and further, means 12 for similarly removing static electricity is installed also between the drying apparatus 6 and the winding apparatus 7. The means 10, 11 and 12 for removing static electricity remove electricity from the multifilament yarns 3 by ionizing air. Thereby, the repulsive force and the attractive force among the multifilament yarns and among a number of filaments constituting the respective multifilament yarns, are eliminated by which the opening operation of the opening apparatus 4 can accurately be performed and the winding operation of the multifilament yarns 3 to the beam 8 at the winding apparatus 7 can be performed accurately.

Bobbins 13 each having a horizontal axial line are mounted to the creel 2 and the multifilament yarns 3 wound to the respective bobbins 13 are drawn.

Figure 3:
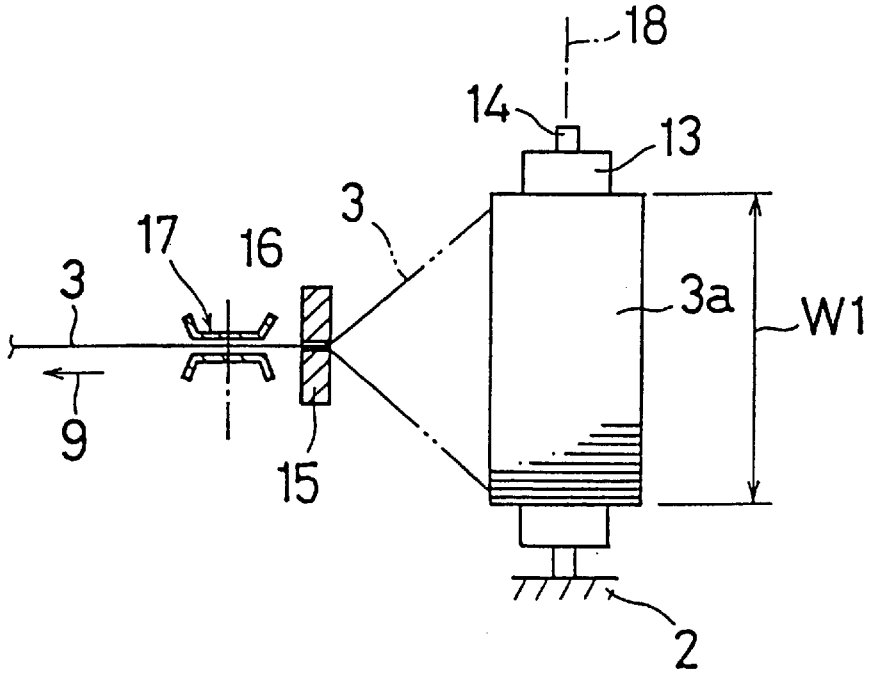
FIG. 3 is a plane view showing a vicinity of a bobbin 13 in a creel 2.

FIG. 3 is a plane view showing a vicinity of the bobbin 13 in the creel 2. The multifilament yarn 3 wound by the bobbin 13 is denoted by a reference notation 3*a*. The bobbin 13 is supported by a peg 14 provided in the main body of the creel 2 by which the bobbin 13 is rotatably supported. Each of the multifilament yarns 3 is inserted into each guide hole 16 of a guide member 15 fixed to the creel 2 and is led to the means 10 for removing static electricity via the tension applying means 17 for applying tension to the multifilament yarn 3 drawn from the bobbin 13. The guide hole 16 of the guide member 15 is arranged to orthogonally shift from a vertical axial line 18 of the bobbin 13 (left of FIG. 1 and FIG. 3). The multifilament yarn 3 is inserted into and guided by the guide hole 16 within a range W1 of a layer of the multifilament yarn 3*a* wound along the direction of the axial line 18 of the bobbin 13 (up and down direction of FIG. 2 and FIG. 3). The guide hole 16 is installed at the central position of the range W1 in the up and down direction of FIG. 3. The multifilament yarn 3 can smoothly be drawn by the constitution of FIG. 3 without causing twist.

Figure 4:
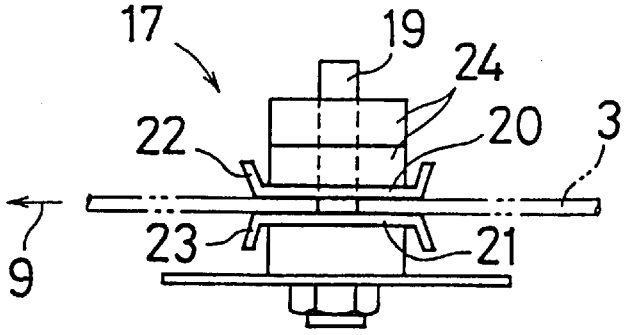
FIG. 4 is a plane view of tension applying means 17.
Figure 5:
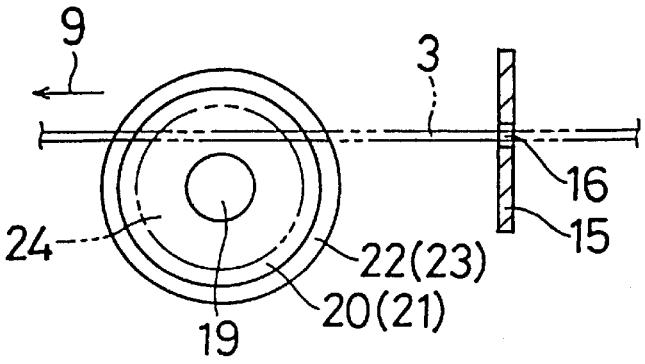
FIG. 5 is a side view of the tension applying means 17.

FIG. 4 is a plane view of the tension applying means 17 and FIG. 5 is a side view thereof. A support shaft 19 having a straight cylindrical shape and a horizontal axial line is erected at the main body of the creel 2. A pair of upper and lower tension washers 20 and 21 are individually, rotatably and coaxially inserted with the support shaft 19. A weight 24 is mounted on the upper tension washer 20. By changing the weight amount by exchanging the weight 24, the gravitational force of the weight 24 and the like operating on the respective multifilament yarn 3 inserted through the upper and lower tension washers 20 and 21, and accordingly the tension can be adjusted. Outwardly directed flanges 22 and 23 which are bent in mutually separating directions along the support shaft 19 are formed at the outer peripheral portions of the tension washers 20 and 21 by which the multifilament yarn 3 can be passed smoothly. The constitution shown by FIG. 3 through FIG. 5 has an advantage where no twist is applied to the multifilament yarn 3 drawn from the bobbin 13.

Figure 6:
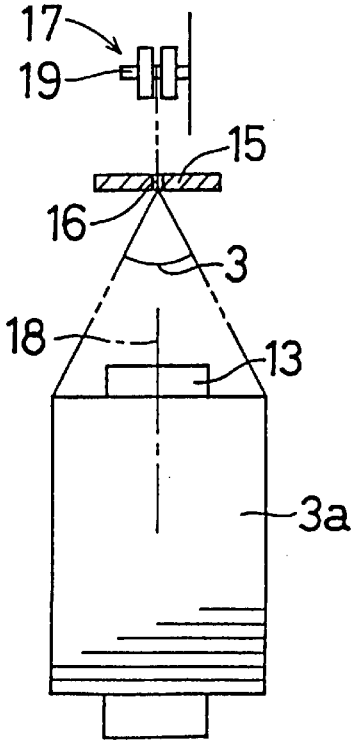
FIG. 6 is a side view of a modified example according to the embodiment of the invention in place of the constitution shown by FIG. 3 through FIG. 5.

FIG. 6 is a side view showing a modified example of the embodiment of the invention in place of the constitution shown by FIG. 3 through FIG. 5. According to the embodiment, the guide member 15 is installed in a direction along the axial line 18 of the bobbin 13 and the multifilament yarn 3 is drawn via the tension applying means 17. The multifilament yarn 3 is made to wrap on the support shaft 19 of the tension applying means 17 by an angle of contact of substantially 90° and is led to the means 10 for removing static electricity. The bobbin 13 is fixed to the support shaft 19 and is not rotated. According to the constitution shown by FIG. 6, although twist is slightly applied to the multifilament yarn 3 drawn from the bobbin 13, the twist practically effects no hazard and the opening operation of filaments in the succeeding opening apparatus 4 can be performed accurately.

Figure 7:
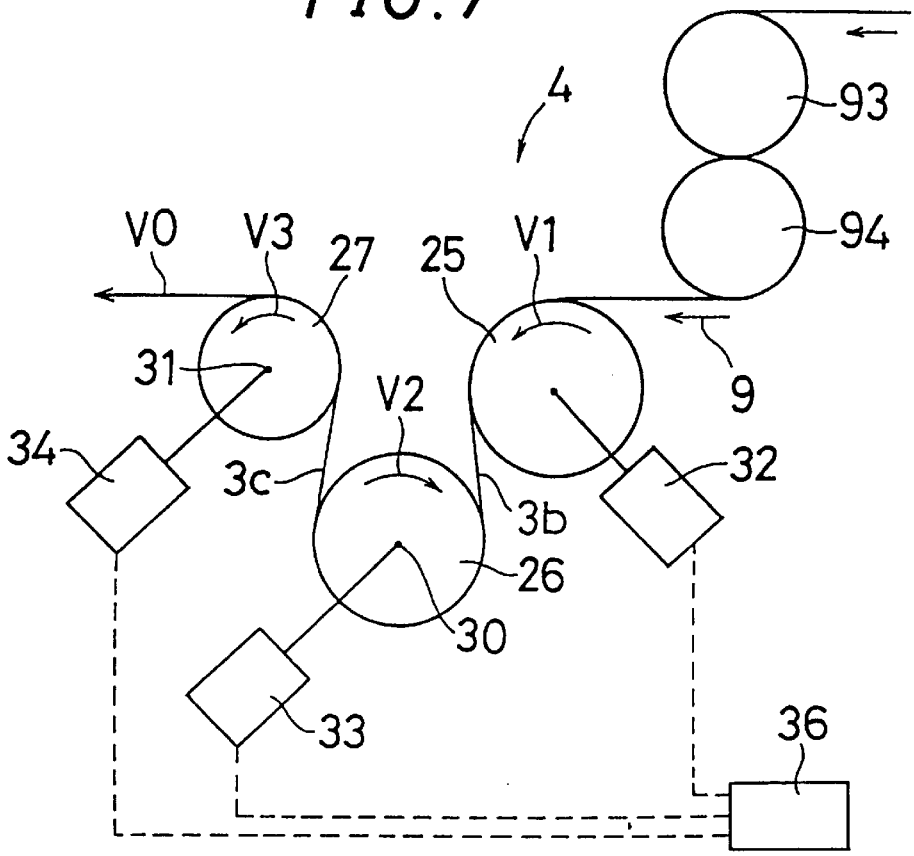
FIG. 7 is a side view of an opening apparatus 4.

FIG. 7 is a side view of the opening apparatus 4. In the opening apparatus 4, first, second and third guide rollers 25, 26 and 27 are arranged in this order in a running direction 9 of the multifilament yarn 3 led by guide rollers 93 and 94. The guide rollers 25, 26 and 27 each have an outer diameter uniform in the horizontal axial line direction (orthogonal to paper face of FIG. 1 and FIG. 7 and up and down direction of FIG. 2), that is, each of the guide rollers has a straight column shape or a straight cylindrical shape and a rotational axis line orthogonal to the running direction 9. The respective guide rollers 25, 26 and 27 each are constituted by forming a fluorine resin coated layer on the outer peripheral face of the roller main body made of a metal such as stainless steel or the like by which the frictional coefficient between the coated layer and the multifilament yarn 3 is reduced thereby enabling the smooth running of the multifilament yarn 3. The fluorine resin may be, for example, polytetrafluoroethylene or Teflon (commercial name) or the like.

The rotational axis lines of the guide rollers 25, 26 and 27 are denoted by reference notations 29, 30 and 31. The axis line 30 is arranged to shift to one side (lower side of FIG. 7) of a horizontal plane including the axis lines 29 and 31. The multifilament yarn 3 is guided by being wrapped on firstly the other side (upper side of FIG. 7) of the guide roller 25 in respect of the plane, successively the outer peripheral face of the guide roller 26 on the one side (lower side of FIG. 7) in respect of the plane and at the lower side of FIG. 7 remote from the plane, and further, on the other side (upper side of FIG. 7) of the roller 27 in respect of the plane.

The outer diameters of the guide rollers 25 and 26 are the same and set at a value exceeding the outer diameter of the guide roller 27.

Direct current motors 32, 33 and 34 constituting driving means are respectively connected to the guide rollers 25, 26 and 27. When peripheral speeds of the rollers 25, 26 and 27 are designated by notations V1, V2 and V3, the direct current motors 32, 33 and 34 are driven to rotate forwardly in the running direction of the multifilament yarn 3 such that the following relationship is established.

$$V1>V2>V3 \quad (1)$$

The tension applying means 17 is installed in the creel 2 upstream from the guide roller 25 of the opening apparatus 4 in the running direction 9. Downstream from the guide roller 27 of the opening apparatus 4 in the running direction 9, a reed 35 for regulating the width of a plurality of the multifilament yarns 3 are installed at the winding apparatus 7. Controlling means 36 is connected to the motors 32, 33 and 34 and controls the speeds of the respective motors 32, 33 and 34. Thereby, between the rollers 25 and 26, the tension of the multifilament yarn denoted by a reference notation **3*b* is lowered upstream therefrom and the tension of the multifilament yarn denoted by a reference notation 3*c* is lowered between the rollers 26 and 27 by which on the outer peripheral face of the guide roller, respective filaments constituting the multifilament yarn 3*c* are disposed contiguously one by one without overlapping in the up and down direction or parallelly disposed with slight intervals therebetween and opened and led to the sizing apparatus 5** on the downstream side.

Figure 8:
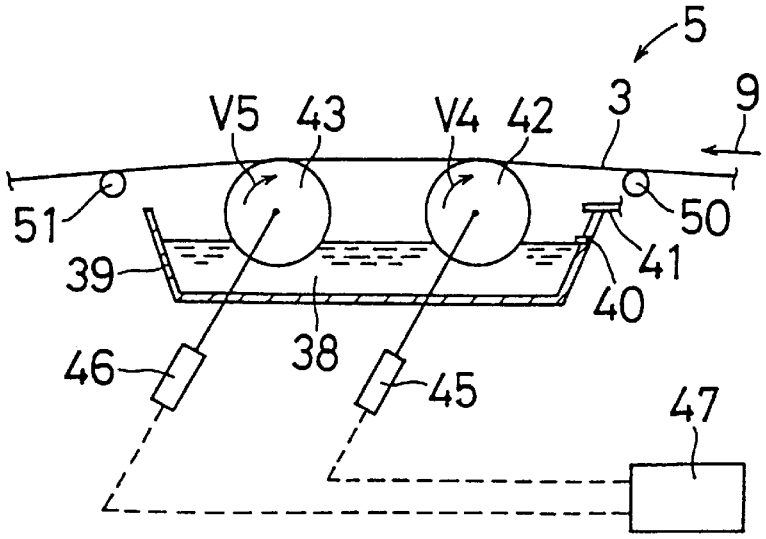
FIG. 8 is a longitudinal sectional view viewing a sizing apparatus 6 from a side direction.

FIG. 8 is a longitudinal sectional view viewing the sizing apparatus 5 from a side direction. A liquid size 38 is stored in a size box 39. The size 38 supplied from a supply tube 41 is made to overflow from an overflow hole 40 installed at the size box 39 by which the liquid level of the size 38 is kept constant. In the size box 39, sizing rollers 42 and 43 each having a horizontal axial line are installed at an interval on the upstream side and the downstream side in the running direction 9 of the multifilament yarn 3. Each of the sizing rollers 42 and 43 has an outer diameter uniform in the axial line direction. Lower portions of the rollers 42 and 43 are disposed below the liquid level 44 of the size 38 and dipped partially in the size. The multifilament yarn 3 is run in contact with the upper portions of sizing rollers 42 and 43. The sizing rollers 42 and 43 are driven to rotate by direct current motors 45 and 46 at peripheral speeds V4 and V5 such that the rotational direction is, for example, set to be reversed to the running direction 9 of the multifilament yarn 3 at the upper portions thereof in contact with the multifilament yarn 3. The motors 45 and 46 are controlled by a control device 47.

The peripheral speeds V4 and V5 are under a relationship therebetween of, for example, V4=V5 and are set to change in accordance with the count of the multifilament yarn 3 and further, the rotational directions thereof are also controlled. For example, when the count of the multifilament yarn 3 is, for example, 1200 deniers or more, or 1300 deniers or more, the sizing rollers 42 and 43 are driven to rotate in the reverse direction as mentioned above by which the size 38 is firmly adhered to the multifilament yarn 3. By contrast, when the count of the multifilament yarn 3 is less than 1200 deniers, for example, in a range of 600 through 1200 deniers, the rotational directions of the sizing rollers 42 and 43 are reverse to arrow marks indicated in FIG. 8. That is, the sizing rollers 42 and 43 are driven to rotate forwardly in the running direction 9 at upper portions thereof in contact with the multifilament yarn 3. As the count of the multifilament yarn 3 is increased, the forward peripheral speeds V4 and V5 are reduced or to null or increased in the reverse direction by which the relative speed difference between the peripheral speeds V4 and V5 of the sizing rollers 42 and 43 and a running speed V0 of the multifilament yarn 3 is increased whereby the size 38 is adhered to the multifilament yarn 3 firmly and uniformly. Rollers 50 and 51 for guiding the multifilament yarn 3 are installed on the upstream side of the sizing roller 42 and on the downstream side of the sizing roller 43.

Fig .9 is a longitudinal sectional view viewing the drying apparatus 6 from a side direction. A housing 54 is formed with an inlet 52 and an outlet 53 for the multifilament yarn 3 and the multifilament yarn 3 runs in the housing 54. A heat source 55 is installed in the housing 54 and air is circulated from the downstream side to the upstream side in the running direction 9 by a blowing apparatus 56 as shown by an arrow mark 57. The heat source 55 may be of a constitution where, for example, vapor is supplied and indirect heat exchange is performed between the vapor and air, or a constitution where an electric heater is embedded therein to heat an infrared ray radiator. The housing 54 is formed with lids 58 and 59 openable by a horizontal pin 89 as illustrated by imaginary lines thereby facilitating maintenance and check in cutting the multifilament yarn 3 during the drying operation and further, circulated air is partially dissipated to the atmosphere to discharge gas after drying.

Figure 9:
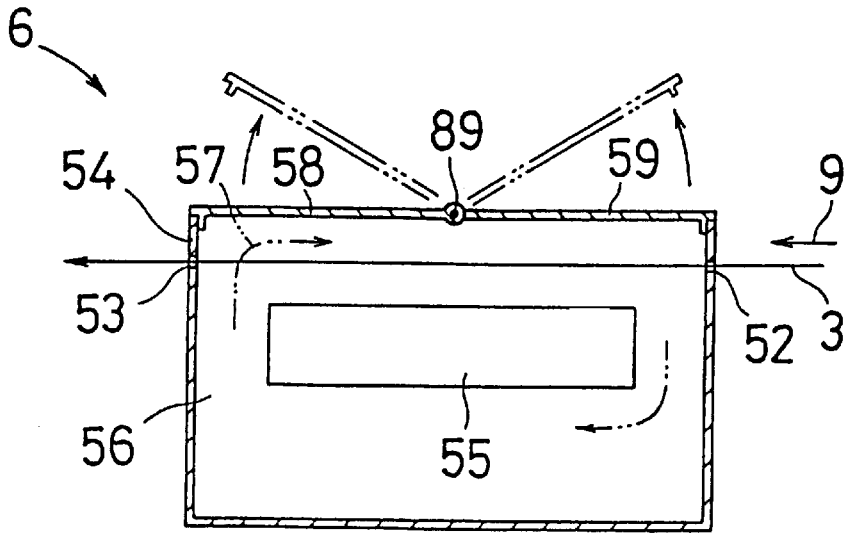
FIG. 9 is a longitudinal sectional view viewing a drying apparatus 6 from a side direction.

The temperature of air in contact with the multifilament yarn 3 falls in a range of, for example, 40 through 60° C., preferably, 40 through 50° C. Thereby, the size can be dried even when the multifilament yarn 3 is constituted by polyethylene fibers having comparatively low heat resistance. The drying apparatus 6 is not limited to the constitution shown by FIG. 9 but may be of other constitution.

Referring again to FIG. 1, the multifilament yarn 3 the size of which has been dried by the drying apparatus 6, is wound to the beam 8 by the winding apparatus 7 via the means 12 for removing the static electricity. The multifilament yarn 3 is provided with a tension by the beam 8, guided by a roller 58 and is wound to the beam 8 disposed below the roller 58. The beam 8 is driven to rotate by a direct current motor 59. The creel 2 is provided with, for example, 600 bobbins 13 wound with multifilament yarns 3 and 600 of the multifilament yarns 3 are simultaneously opened by the opening apparatus 4, sized, dried and wound to the common beam 8.

Figure 10:
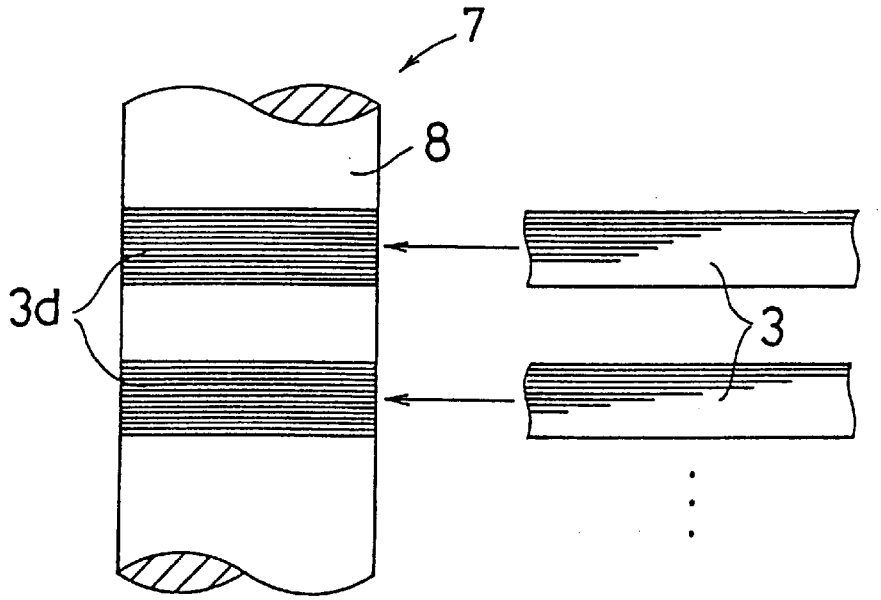
FIG. 10 is a simplified plane view showing a multifilament yarn 3 dried by the drying apparatus 6 and wound by a winding apparatus 7.

FIG. 10 is a simplified plane view of the multifilament yarns 3 dried by the drying apparatus 6 and wound to the beam 8 by the winding apparatus 7. The respective multifilament yarns 3 each comprising 195 of filaments as described above, are sized in a flat sectional shape and wound to the beam 8 in a straight cylindrical shape contiguously in the axial direction at intervals as denoted by a reference notation 3*d*.

Figure 11:
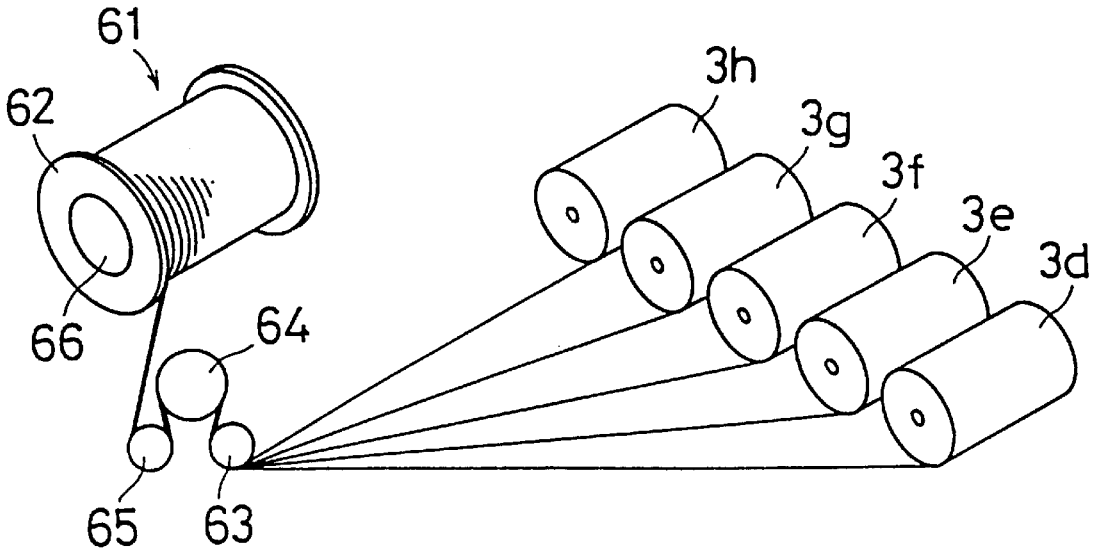
FIG. 11 is a view showing in a simplified manner an apparatus for continuously bundling each of a multifilament yarn 3*d* and multifilament yarns 3*e* through 3*h* having a similar constitution to that of the multifilament yarn 3*d*, which are obtained from the constitution of FIG. 1 through FIG. 10 and wound by a beam 8, and rewinding them to a warp beam 62 by a beaming apparatus 61.

FIG. 11 is a view showing in a simplified manner an apparatus for winding contiguously in the axial direction of a beam 66 a total of 3000 (=600×5) multifilament yarns including multifilament yarns 3*d* through 3*h* and multifilament yarns 3*e* through 3*h* having the same constitution as that of the multifilament yarns 3*d* through 3*h*, obtained from the constitution of FIGS. 1 through 10, to a single warp beam 62 by a beaming apparatus 61. According to the beaming apparatus 61, as mentioned above, 3000 of the respective multifilament yarns 3*d* through 3*h* are guided by rollers 63 through 65 and the respective filament yarns are disposed closely contiguous to each other at the beam 66 and wound for weaving by a succeeding weaving machine. The beam 66 is driven to rotate by a direct current motor and winds the multifilament yarns 3*d* through 3*h* by applying a pertinent tension for each thereof by braking the drum 66.

Figure 12:
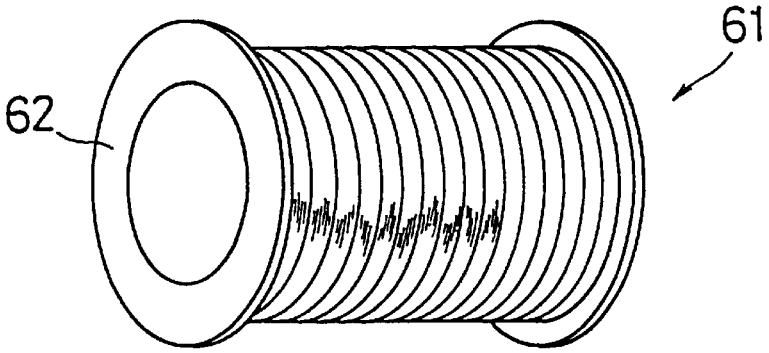
FIG. 12 is a simplified perspective view of the warp beam 62.

FIG. 12 is a simplified perspective view of the finished warp beam 62. The respective multifilament yarns 3*d* through 3*h* are wound by the drum 66 closely contiguous to each other in the axial direction by which the weaving preparatory process is finished.

Figure 13:
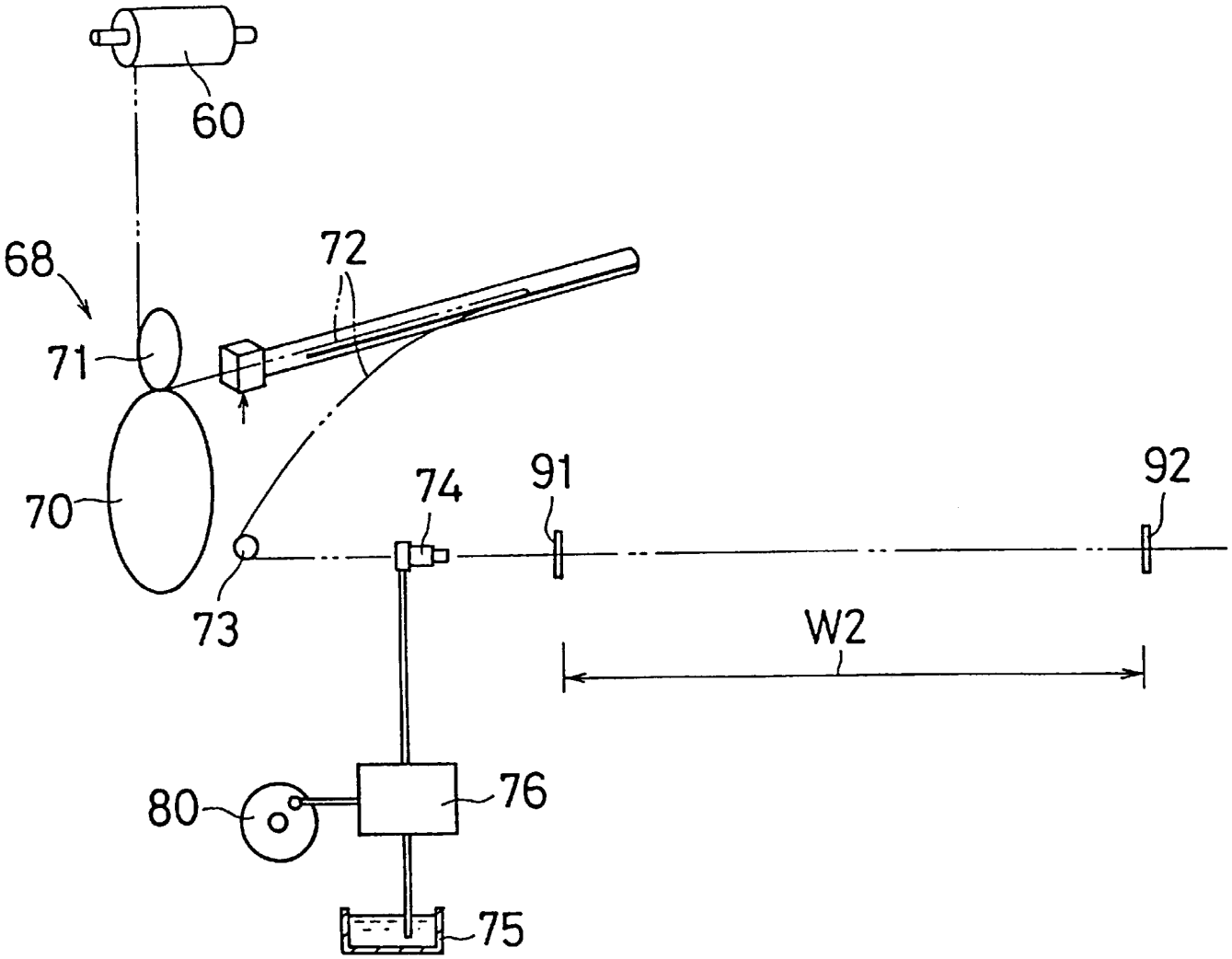
FIG. 13 is a perspective view showing a simplified portion of a water jet loom 68.

The warp beam 62 is woven to a bulletproof woven fabric by a water jet loom 68 shown by FIG. 13. The multifilament yarn 3 shown by FIGS. 1 through 11 is used as a warp. Throughout the specification, the reference notation 3 summarizingly represents the reference notations 3*a* through 3*h* and is used to represent a multifilament yarn used as a warp and a warp.

In respect of the water jet loom 68, a weft 69 that is a multifilament yarn, is wound by a bobbin, that weft 69 is not twisted nor subjected to opening and sizing operations. The length of the weft 69 for one weaving portion 72 is determined by a measuring roll 70 and a hold roller 71, and the weft 69 is extended from the bobbin 60 and stored in a pooling pipe 97 to enter a water jet nozzle 74 via a guide piece 73 at a pertinent timing. Separately, water in a tank 75 is made to enter the nozzle 74 from a jet pump 76. In the nozzle 74, water and the weft 69 are jointed together, the weft 69 is flown by a jet stream of water and is put into weft inserting motion for inserting into a shed that is an opening formed by upper and lower ones of the warps 3. The weft 69 is cut by cutting means 91 and 92 at both end portions of a weave width W2. Such a series of operations are repeated.

Figure 14:
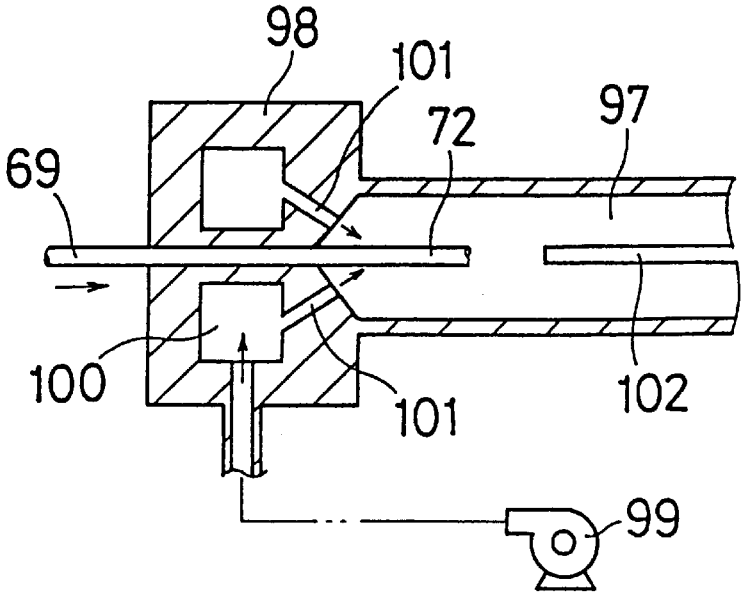
FIG. 14 is a sectional view showing in a simplified manner a portion of a pooling pipe 97 and the constitution of a blowing block 98 connected to a base end portion of the cooling pipe 97.

FIG. 14 is a sectional view showing a portion of the pooling pipe 97 and a blowing block 98 connected to a base end portion thereof. In respect of the weft 69 from the length measuring roll 70 and the hold roller 71, compressed air pressurized and fed from a fan 99 is led to an air chamber 100 of the block 98 and is injected from nozzle holes 101 inclined to the downstream side (right of FIG. 14) toward the axial line along a straight line of the weft 69. By injection of air from the nozzle holes 101, the weft 69 is dragged and stored in the pooling pipe 97. By dragging the weft 69 in the pooling pipe 97, the plurality of filaments constituting the weft 69 are disintegrated apart and brought into a so-called opened state.

Figure 15:
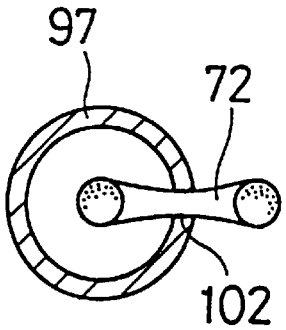
FIG. 15 is a sectional view orthogonal to the axial line of the pooling pipe 97.

FIG. 15 is a sectional view orthogonal to the axial line of the pooling pipe 97. A notch 102 is formed at a side portion of the pooling pipe 97 along the axial line of the pooling pipe 97. The one weaving portion 72 of the weft 69 dragged into the pooling pipe 97 by compressed air from the nozzle holes 101, is taken out from the notch 102 and guided to the guide piece 73. The filaments opened in the pooling pipe 97 are opened also at the nozzle 74 mentioned below, and constitute the multifilament yarns each having a cross-sectional face of a shape flattened as a whole by arranging the respective filaments by the warps. A free end portion of the pooling pipe 97 opposed to the blowing block 98 is opened.

Figure 16:
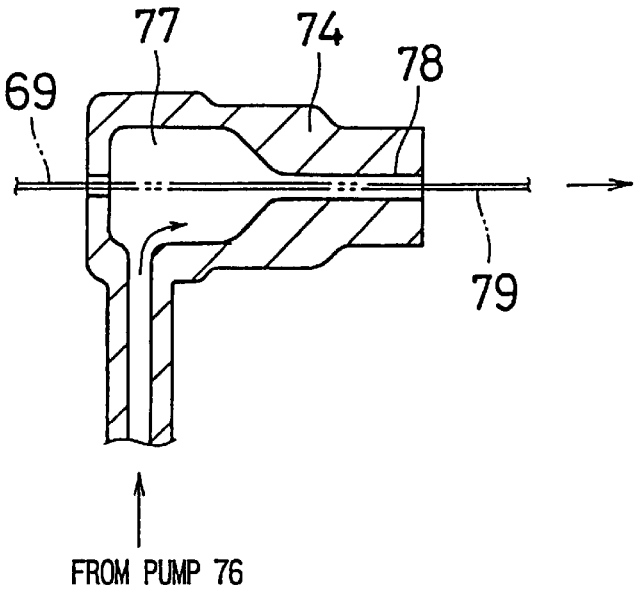
FIG. 16 is a sectional view of a water jet nozzle 74.

FIG. 16 is a sectional view of the water jet nozzle 74. The weft 69 is led to a chamber 77 in which high pressure water is supplied from a pump 76 and the weft 69 and water are injected together from a nozzle hole 78 as denoted by a reference notation 79. The shape of the nozzle hole 78 is constituted such that water is easy to converge and fly and the speed of the jet stream is determined such that water is kept in a shape of a water rod and water is not atomized. The injection of water is carried out over an entire length of the weft 69 in a state of flying the weft 69 or finished in the midst of flying and thereafter, the weft 69 is kept flying by the inertia and viscosity of water. Accordingly, even if the jet stream is shifted from the weft, there causes no push up from behind by which meandering of the weft 69 can be prevented.

According to the invention, the weft 69 is flown by using water and therefore, the weft 69 is brought into an opened state while flying the weft 69 in which the orientation of fiber is kept excellent and the weft 69 is kept in a state where intervals among the filaments are slightly separated apart. In this way, the flow rate, the speed, the pressure, the injection time period and the like of the water jet stream are adjusted, and the pump 76 and the driving means 80 for driving the pump 76 such as a cam or the like are constituted.

Figure 17:
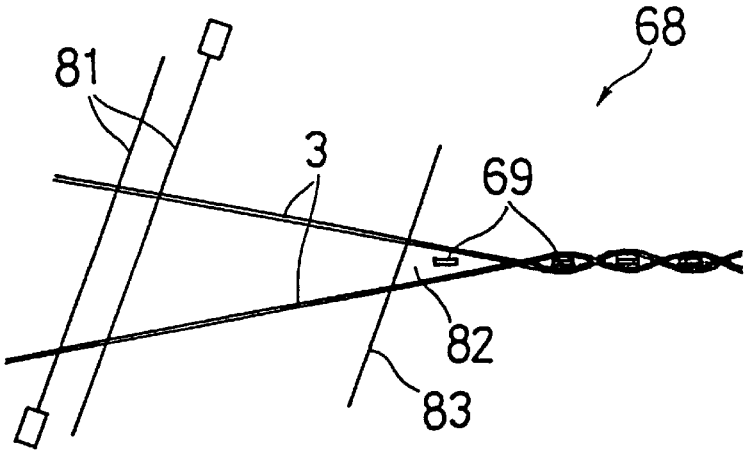
FIG. 17 is a simplified perspective view showing a portion of the water jet loom 68.

FIG. 17 is a simplified perspective view showing a portion of the water jet loom 68. The warps 3 loomed to the loom 68 as the warp beam 62, are separated upwardly and downwardly by a heald 81, the shedding motion for producing a shed 82 for passing the wefts 69 is performed, the weft 69 flown by the water jet described in reference to FIG. 13, is inserted into the shed 82 and thereafter, the reed 83 is advanced to right of FIG. 17 and the weft 69 is pushed to the weave front thereby performing a beating-up motion.

According to experiments of the inventors, it has been confirmed that in respect of the water jet loom 68, the weaving operation could be performed by the weft inserting motion of the weft from the nozzle 74 at a high speed of 430 times/minute.

According to the invention, a shuttleless loom such as an air jet loom, a gripper shuttle loom, a Rapier loom or the like may be used in place of the water jet loom.

Figure 18:
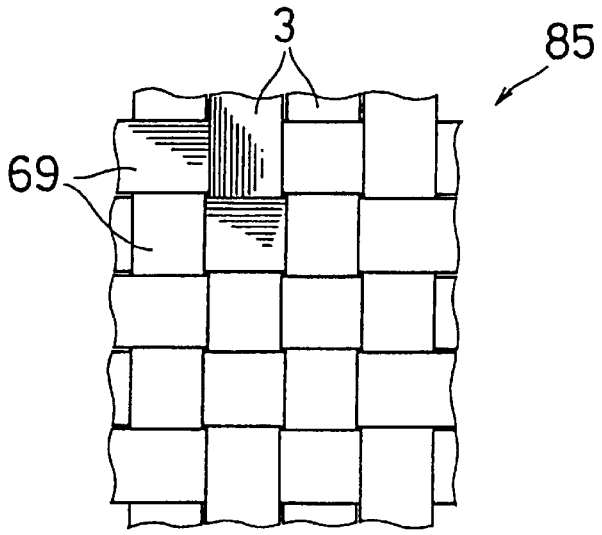
FIG. 18 is a plane view enlarging a woven fabric 85 woven by the above-described embodiment of the invention.

FIG. 18 is a plane view enlarging a woven fabric 85 that is woven in accordance with the embodiment of the invention. The warps 3 and the wefts 69 are woven in a plain weave and the warps 3 and the wefts 69 are brought into a state of being opened. The woven fabric is desized. The desizing operation is carried out by using a desizing agent. Further, the degumming operation is performed for cleaning the woven fabric. Incidentally, the desizing and degumming may be omitted.

It is preferable that the multifilament yarn 3 that is a grey yarn used as the warp, comprises, for example, polyethylene fibers and has a tensile strength of 30 g/d or more and an initial tensile modulus of 900 g/d or more. Each of, for example, 195 filaments constituting the multifilament yarn, has a count of less than 10 deniers. A single one of the multifilament yarns fabricated thereby has a count of, for example, 50 through 1600 deniers, for example, 200 deniers. The weft 69 may be made of a material the same as that of the warp 3. With regard to polyethylene fiber described above, the theoretical strength that is the strength of one molecule is 372 g/d, the molecular chain length that is the length of one molecule is long, the molecular weight of raw material is about 4 or 5 million, directions of molecular chains are aligned by performing melting and superdrawing, a large strength is achieved in a direction of fiber axis and the fiber is also excellent in wear resistance, fatigue resistance, impact resistance and light resistance.

Although the mechanical properties of polyethylene fiber used for the weft 3 and the warp 69 are excellent as described above, the softening and melting point is as low as, for example, about 80° C. Such a problem can successively be dealt with by using polyethylene fiber for either one of the weft 3 and warp 69 and a material excellent in a thermal property, for example, aramide fiber known as kevlar or the like for the other of the weft 3 and warp 69. The softening and melting temperature of aramide fiber is as high as about 320° C. through 570° C. or higher and the mechanical properties are comparable to polyethylene fiber in practice although generally a little inferior thereto. The tensile strength of the multifilament yarn comprising aramide fibers is 20 g/d or higher or 500 g/d or higher.

According to another embodiment of the invention, the woven fabric may be manufactured by employing polyethylene fiber for a portion of the plurality of warps 3 and aramide fiber for the remainder thereof, and similarly with respect to the wefts 69 by mixing the multifilament yarns of polyethylene fiber and aramide fiber. For example, multifilament yarns of 200 deniers each having 195 filaments comprising polyethylene fibers, and multifilament yarns of 200 deniers each having 195 filaments comprising aramide fibers may respectively and alternately be used one by one for the warps and multifilament yarns of 200 deniers having 195 filaments comprising polyethylene fibers and multifilament yarns of 200 deniers each having 195 filaments comprising aramide fibers may respectively and alternately be used one by one for the wefts similar to the warps thereby constituting a plain weave.

Figure 19:
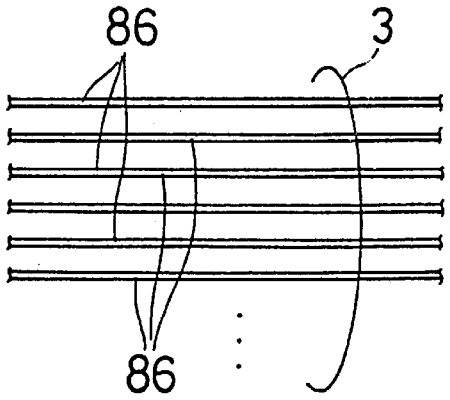
FIG. 19 is a plane view magnifying the multifilament yarn 3 according to still other embodiment of the invention.

FIG. 19 is a plane view enlarging a single multifilament yarn 3 according to still another embodiment of the invention. The multifilament yarn 3 is a combined filament yarn in which a filament denoted by a reference notation 86 may be, for example, of polyethylene fiber and a filament denoted by a reference notation 87 may be, for example, of aramide fiber. The filaments 86 and 87 may be of still other kind of chemical fiber. Further, the single multifilament yarn 3 may be constituted by a combined filament yarn of filaments comprising three or more kinds of chemical fibers. Although the multifilament yarn 3 may be used as the warp, the yarn 3 may be used also as the weft or either one or both of the warp 3 and the weft 69 may be constituted by a combined filament yarn. According to the experiments by the inventors, it has been confirmed that the respective woven fabrics shown by FIG. 18 and FIG. 19 have excellent bulletproof ability and mechanical and thermal properties.

A material of the multifilament yarn may be a fiber formed by subjecting poly(paraphenylene 2,6-benzobisoxazole) to a liquid fiber forming operation and the multifilament yarn may be used both for the warp and the weft, or the warp or the weft. The softening and melting point is about 600° C. or higher, the material is excellent in heat resistance and flame resistance and in mechanical property, extremely flexible, and has a soft feeling. The multifilament made of such a material may be combined with polyethylene fibers or with aramide fibers in a combination as described above.

In this way, according to the invention, a woven fabric which is improved in mechanical and thermal properties by complementing drawbacks of respective multifilament yarns made of a plurality of kinds of materials is realized.

The invention may be embodied in other specific forms without departing from the sprit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of weaving a bulletproof woven fabric in which a water jet loom is used, the method comprising:

in respect of warp, opening a multifilament yarn;

sizing the opened multifilament yarn;

thereafter, drying the sized multifilament yarn; and looming the dried multifilament yarn to the water jet loom, and in respect of weft, flowing a multifilament yarn by a water jet stream without opening and sizing to weft-insert at the water jet loom.

2. The method of weaving a bulletproof woven fabric of claim 1, wherein in the sizing operation is used a size including polyvinyl alcohol or an acrylic group size material.

3. The method of weaving a bulletproof woven fabric of claim 1, wherein desizing is performed after weaving the fabric.

4. A method of weaving a bulletproof woven fabric of claim 1, wherein the weft is brought into the opened state by adjusting the water jet stream during flying of the weft.

5. An apparatus of weaving a bulletproof woven fabric comprising:

opening means for opening warp made of a multifilament yarn;

sizing means for sizing the multifilament yarn of the warp sized by the sizing means; and a water jet loom, to which the warp from the sizing means is loomed, for flowing weft made of a multifilament yarn by a water jet stream without opening and sizing the multifilament yarn of the weft, to weft-insert at the water jet loom.

* * * * *